United States Patent [19]

Kramer

[11] 4,002,243

[45] Jan. 11, 1977

[54] JIB CRANE

[75] Inventor: Edward R. Kramer, Macedonia, Ohio

[73] Assignee: Stanspec Co., Cleveland, Ohio

[22] Filed: Jan. 15, 1976

[21] Appl. No.: 649,221

Related U.S. Application Data

[63] Continuation of Ser. No. 531,605, Dec. 11, 1974, abandoned.

[52] U.S. Cl. ..... 212/56; 16/163

[51] Int. Cl.[2] ..... B66C 23/06

[58] Field of Search ..... 16/163, 164; 212/63, 212/12, 55, 61–65, 33, 56; 214/75 H

[56] References Cited

UNITED STATES PATENTS

| | | | |
|---|---|---|---|
| 399,582 | 3/1889 | Sullivan | 16/163 |
| 2,200,692 | 5/1940 | Fairley | 16/163 |
| 2,362,416 | 11/1944 | Spoliansky | 212/63 |

FOREIGN PATENTS OR APPLICATIONS

| | | | |
|---|---|---|---|
| 314,135 | 7/1929 | United Kingdom | 212/63 |

*Primary Examiner*—Robert J. Spar
*Assistant Examiner*—Lawrence J. Oresky
*Attorney, Agent, or Firm*—Woodling, Krost, Granger & Rust

[57] ABSTRACT

A jib crane supportable on a plurality of vertically spaced pairs of articulated joints disposed along first and second common axes laterally spaced apart and disposed parallel to each other to provide for horizontal swinging of the jib crane on both the first and second common axes, the upper of the pairs of joints being connected to the lower of the pairs of joints by a vertical post member to resist forces tending to displace or mis-align the joints from said common axes, respectively. The vertical post member preferably is equidistant of the said first and second common axes. The vertical distance between the upper and the lower joints is several times the distance between the said first and second common axes. This is an abstract only of the specific illustration of the invention given by way of example, and is not to be used in the interpretation of the claims nor as a limitation on the scope of the invention.

5 Claims, 9 Drawing Figures

Fig. 1
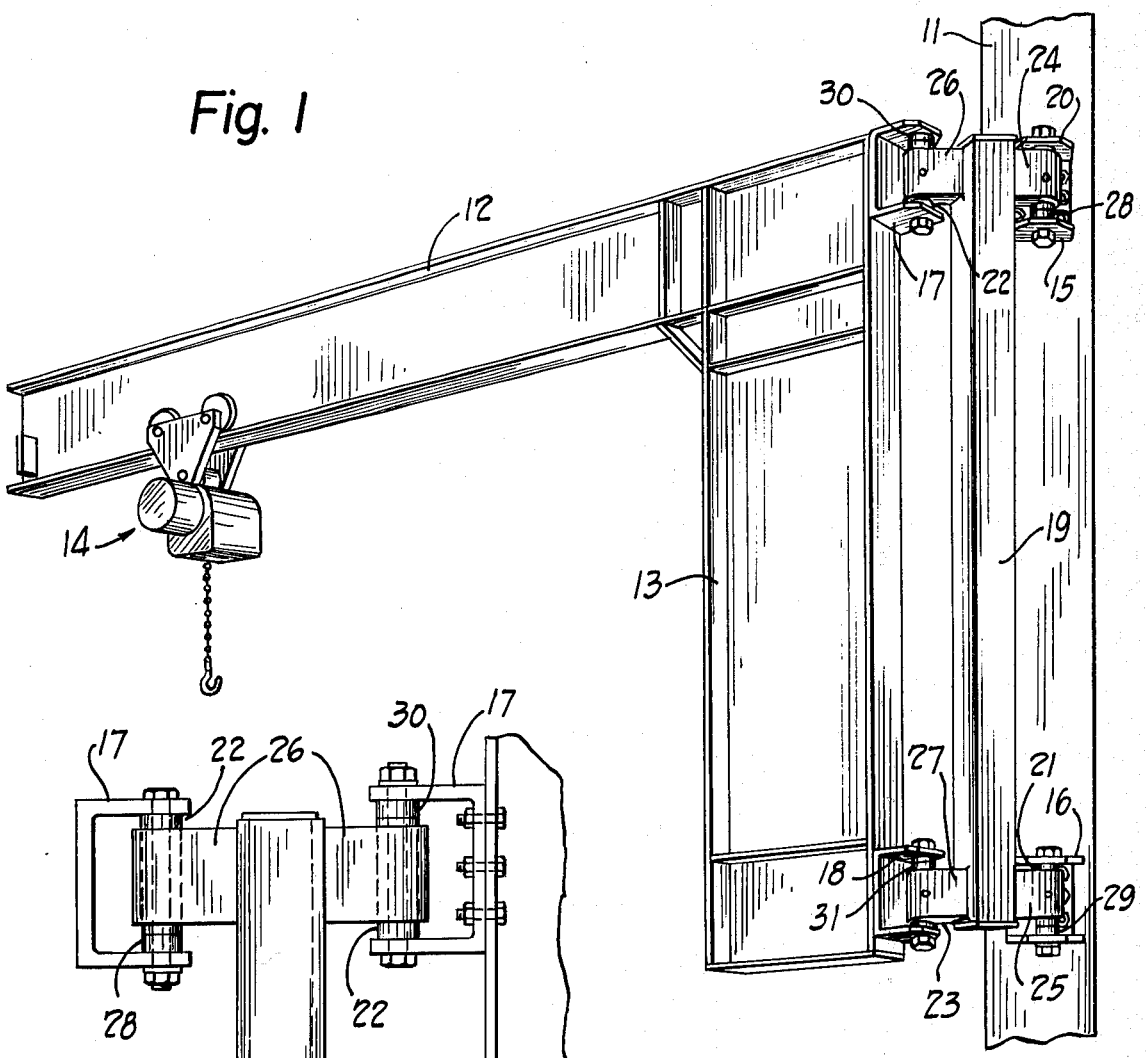
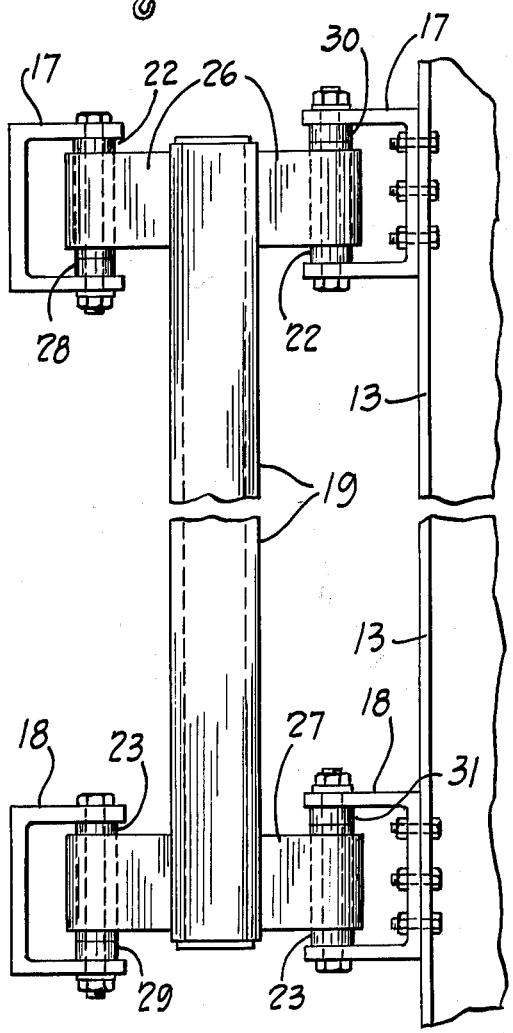
Fig. 2

JIB CRANE

This is a continuation of application Ser. No. 531,605 filed Dec. 11, 1974, now abandoned.

My invention relates to jib cranes carried by an upright supporting member and adapted to swing in a horizontal plane whereby loads carried by the boom or horizontal arm of the jib crane can be moved about from various locations to other various locations.

An object of my invention is to improve the universality of the movement of the boom so as to add to the locations that may be reached by the load-carrying trolley hoist on the boom.

Another object is to provide for a double articulated jib crane whereby the jib crane is swingable on two axes laterally spaced apart and parallel to each other.

Another object is the provision for resisting forces tending to displace or mis-align upper and lower joints of pairs of joints supporting the jib crane on a plurality of spaced apart axes.

Another object is the provision in such a double articulated boom for preventing rotation or twisting of the jib crane that may be imparted thereto upon the boom of the jib crane being disposed at an angle, such as a right angle, from a vertical plane coinciding with another position of the boom.

Other objects and a fuller understanding of this invention may be had by referring to the following description and claims, taken in conjunction with the accompanying drawings, in which:

FIG. 1 is a plan view of my improved jib crane apparatus mounted upon an upright supporting member and showing the boom swung in an arc around a first axis and in another arc about a second axis, the two axes being laterally spaced apart and parallel to each other;

FIG. 2 is an enlarged view, partially in section, showing details of the mounting of the articulated joints to the jib crane;

FIG. 5 shows the boom extending straight out from the supporting member, that is at substantially 180° to the supporting member;

FIG. 6 shows the boom swung around in one direction to a position at substantially 90° to the supporting member;

FIG. 7 shows the boom swung around in an opposite direction at 90° from the supporting member;

FIG. 8 shows the boom swung around in one direction on both common axes to dispose of the boom at more than 180° from its position shown in FIG. 5; and FIG. 9 shows the boom swung around in an opposite direction on both common axes to more than 180° from its position shown in FIG. 5.

Figure 3:
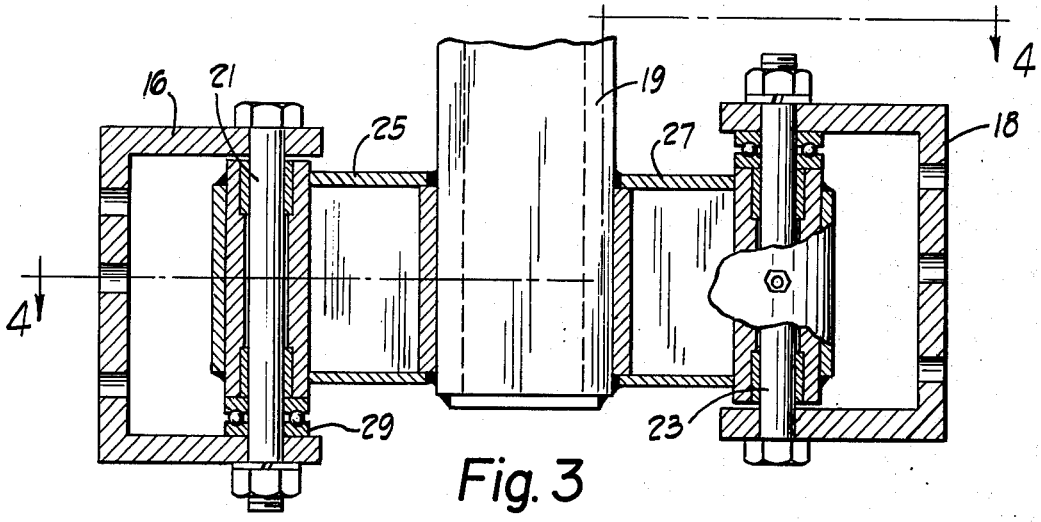
FIG. 3 is an enlarged sectional view showing details of the joints utilized for securing the jib crane to an upright member, FIG. 3 showing the lower most of the spaced apart joints.
Figure 4:
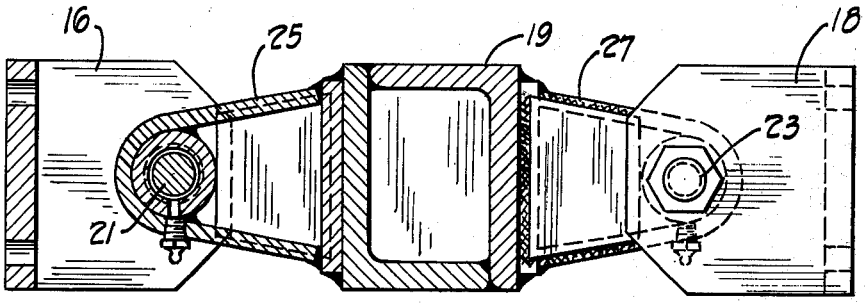
FIG. 4 is a view, partially in section, showing the lowermost joints and is in a view-looking in the direction of the arrows 4—4 of FIG. 3.

My improved jib crane apparatus is adapted to be mounted upon an upright supporting member such as the I beam 11 securely mounted to bear the weight of the crane and the load carried thereby.

The jib crane has a horizontal arm or boom portion 12 which is adapted to be swung in a horizontal plane. It is adapted to carry thereon a load-carrying trolley hoist 14 of the usual kind. Rigidly and firmly secured to the boom or arm portion 12 at its end closest to the supporting member 11 is a vertically extended column portion 13 of the jib crane. The boom portion 12 and the column portion 13 are disposed at right angles to each other as illustrated.

Securely mountable to the supporting member 11 at an upper elevation thereof is a hinge fitting 15. Fixedly mountable to the supporting member 11 at a lower elevation is a lower hinge fitting 16. These hinge fittings 15 and 16 are vertically spaced apart as illustrated. They are adapted to be so firmly and fixedly secured to the supporting member 11 as to carry the weight of the jib crane and the load carried thereby. The hinge fittings 15 and 16 constitute a first pair of hinge fittings mountable to the supporting member 11.

Fixedly mounted to the column portion 13 of the jib crane adjacent the upper end thereof is a hinge fitting 17 as illustrated. Fixedly mounted to the column portion 13 adjacent a lower end thereof is a lower hinge fitting 18. The hinge fitting 18 is vertically spaced from the hinge fitting 17. These hinge fittings 17 and 18 constitutes a second pair of hinge fittings. Carried by the jib crane, spaced laterally from the column portion 13, and also parallel to the column portion 13 is a rigid post member 19. This post member 19 may be a rectangular column as illustrated, may be a cylinder, or may be a heavy plate. The preferred form of the post member is as illustrated. Firmly secured to and extending laterally from the post member adjacent the upper end thereof is an ear member 24 and directed toward the hinge fitting 15 so as to protrude between the spaced arms of the hinge fitting 15. Fixedly secured to and laterally extending from the post member 19 is a lower ear member 25 which extends toward the hinge fitting 16 and protrudes between the spaced arms of the fitting 16. These ear members 24 and 25 constitute a first pair of ear members.

The ear member 24 is pivotally connected to the hinge fitting 15 by a pivot assembly 20 whereby the ear member 24 may be pivotally swung around the pivot assembly 20 carried by the hinge fitting 15. Pivotally connecting the ear member 25 and the hinge fitting 16 is a pivot assembly 21 so arranged that the ear member 25 may be pivotally swung around the pivot assembly 21 carried by the hinge fitting 16. The pivot assemblies 20 and 21 are disposed on a first common axis as illustrated. Fixedly secured to the post member 19 adjacent its upper end and corresponding to the level of the ear member 24 is an ear member 26 which extends in the opposite direction toward the hinge fitting 17 so as to protrude between the spaced arms of the fitting 17. Fixedly secured to the post member 19 adjacent the lower end thereof is an ear member 27 corresponding in elevation to that of the ear member 25, the ear member 27 extending toward the hinge fitting 18 and protruding between the spaced arms of the hinge fitting 18. The ear members 26 and 27 constitute a second pair of ear members.

There is a first pivot assembly 22 pivotally connecting the ear member 26 with the hinge fitting 17 whereby the hinge fitting 17 may pivotally swing relative to the ear member 26. A pivot assembly 23 pivotally connects the ear member 27 to the hinge fitting 18 whereby the hinge fitting 18 may pivotally swing relative to the ear member 27. The pivot assemblies 22 and 23 constitute a second pair of pivot assemblies. The pivot assemblies 22 and 23 are on a second common axis.

It is to be noted that the common axis through both pivot assemblies 20 and 21, referred to as a first common axis, is laterally spaced from and parallel to the common axis of the pivot assemblies 22 and 23, referred to as a second common axis. These two common axes are at all times maintained laterally spaced from each other and disposed parallel to each other.

To help bear the axial thrust between the respective fittings and ear members, there are provided thrust bearings 28, 29, 30 and 31 positioned as illustrated.

Figure 5:
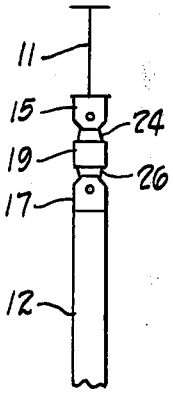
FIGS. 5, 6, 7, 8 and 9 are views, largely diagrammatical in natrue, illustrating various positions of the many permitted positions of the crane boom relative to an upright supporting member.

The versatility of the doubly articulated jib crane apparatus is illustrated by the views, largely diagrammatical, of FIGS. 5, 6, 7, 8 and 9. As seen in FIG. 5 the boom 12 extends straight out from the I beam 11 constituting the supporting member. The boom 12 may be considered as extending at 180° to the web of the I beam 11. It will be seen that the load is carried on the pivot assemblies along both of the common axes, with the post member 19 interposed therebetween. In this view the web of the I beam, the two common axes, the post member 19 and the boom 12 are in a common vertical plane.

Figure 6:
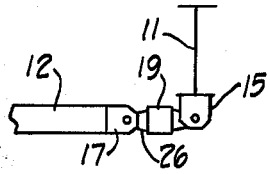

In FIG. 6 the boom has been swung in one direction whereby it is disposed at substantially right angles to the I beam 11 constituting the supporting member. It will be noted that the weight of the boom and the load carried thereby tend to displace or mis-align the pivot assemblies from the described common axes. This may be referred to as a twisting or rotation of the jib crane about a horizontal axis intermediate of the upper and lower joints porvided by the described ear members in complementary fittings. The post member 19 tends to resist such a force that would tend to mis-align or displace the pivot assemblies from their respective axes along which disposed.

Figure 7:
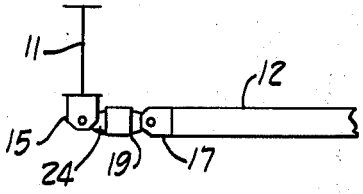

In FIG. 7 the boom 12 has been swung in an opposite direction to a position substantially at right angles to the web of the I beam 11 constituting a supporting member. Again, the weight of the boom and load carried thereby tends to twist or rotate the jib crane so as to tend to mis-align or displace the pivot assemblies from the common axis along which each is disposed. Again, the post member 19 interposed between the spaced pairs of joints made up of the ear members and their respective hinge fittings resists such a twisting or rotation.

Figure 8:
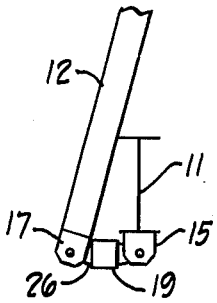

FIG. 8 illustrates further the versatility of the jib crane apparatus in that the boom 12 is swung around to a location rearwardly of the I beam more than 180° from its position shown in FIG. 5. Again, the post member 19 performs the function of resisting such twisting or rotation as would mis-align or displace the pivot assembles from their proper positions along their respective axes.

Figure 9:
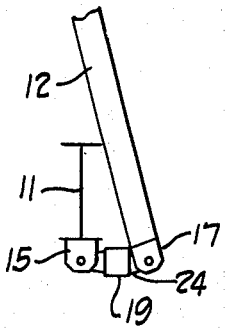

FIG. 9 is a view similar to that of FIG. 8 but with the boom swung around in an opposite direction to where the boom reaches behind the I beam 11 and extends at more than 180° from the position illustrated in FIG. 5.

It may be seen that my improved jib crane apparatus is doubly articulated in that it has one pair of joints at an upper elevation and another pair of joints at a lower elevation. The importance of the mounting of the rigid post member 19 between the upper and lower pairs of joints is appreciated by observing the twisting and rotation that would occur in the absence of the post member 19. By having the post member 19 positioned and mounted as shown, the pivot assemblies constituting the pivot pins and bearings are so maintained as to facilitate easy swinging with minimum binding that might otherwise occur in the absence of the post member 19. It is noted that the length of the post member 19 and hence the distance between the upper and lower pairs of joints is several times the lateral distance between the spaced common axes provided by the pivot assemblies. This considerable greater distance maximizes the resistance provided by the post member 19 against the twisting and rotation that would occur in the absence of such a post member.

It is preferred that the axis of the post member 19 be about midway, and most preferably substantially equidistant of the said first common axis through the pivot assemblies 20 and 21 and the said second common axis through pivot assemblies 22 and 23. It is also preferred that the distance measured vertically from the level of the upper pivot assemblies 20 and 22 down to the level of the lower pivot assemblies 21 and 23 be substantially greater than the laterally measured distance between the said two common axes between the pivot assemblies, and that this vertically measured distance be several times the said laterally measured distance such as on the order of about three to eight or more times, as for example about six times in the embodiment illustrated and described. The vertical distance between the level of the upper joints and the level of the lower joints is also substantially greater, and preferably several times the maximum lateral distance between the supporting member and the post member. These described and shown relationships aid in providing maximum stability and resistance to the described tendency of the jib crane to twist or rotate.

My improved structural arrangement provides not only a greater versatility in the movemnet in the boom than heretofore readily obtained, but also provides means for preventing binding and mis-alignment of the several pivot assemblies heretofore described and shown in the drawings.

The present disclosure includes that contained in the appended claims, as well as that of the foregoing description.

Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. In a jib crane apparatus mountable on an upright supporting member for swinging of the jib crane in a horizontal plane and relative to the supporting member, said jib crane being adapted to carry and swing a load in arcs about two parallel spaced axes in alternative opposite directions on each of said axes whereby twisting actions are imparted by the jib crane dependent on the position of the jib crane upon being swung in one of said alternative directions on said axes, said jib crane including a generally horizontal boom portion and a generally vertical column portion fixedly secured to said horizontal boom portion at its end closest to said supporting member and extending from said boom portion generally parallel to said upright supporting member, the combination of a first pair of hinge parts adapted to be secured to said supporting member at vertically spaced locations thereon, a second pair of hinge parts secured to said vertical column portion of the jib crane at generally vertically spaced locations corresponding generally to the locations of said first pair of hinge parts respectively, a post member spaced laterally of, and parallel to, said vertical column portion of the jib crane, a first pair of complementary hinge parts secured to and extending from said post member at generally vertically spaced locations corresponding generally to the elevation of the location of said first pair of hinge parts, respectively, to be connected therewith, first pivot means pivotally connecting said first pair of hinge parts and said first pair of complementary hinge parts, respectively, for pivotal movement about a first common axis, a second pair of complementary hinge parts secured to, and laterally extending from, said post member at generally vertically spaced locations corresponding generally in vertical location to the elevation of the locations of said second pair of hinge parts, respectively, to be connected therewith, the lateral dimensions of said post member being substantially greater than the lateral dimensions of the hinge parts of the locations of said pivot means, and second pivot means pivotally connecting said second pair of hinge parts and said second pair of complementary hinge parts, respectively, for pivotal movement about a second common axis, said first and second means each oncluding bearing means, said first and second common axes being spaced apart and disposed parallel to each other, said post member being vertically disposed and spaced substantially equidistantly from said common axes to be subjected to substantially equal degrees of twisting action imparted by the jib crane being swung in either of said arcs about said spaced common axes to positions in any of said alternate directions, the lateral distance between said common axes being substantially less than the maximum vertical extent of the post member between the uppermost and lowermost hinge parts, said post member extending substantially through the vertical extend of said hinge parts providing the said first and second pivot means to assist the said hinge parts to resist said twisting action.

2. The combination claimed in claim 1 wherein the hinge parts and complementary hinge parts are U-shaped members and ear members wherein the ear members extend into the open space of the U, and the pivot means extend through aligned openings in the U-shaped members and ear members to provide articulated joints along said common axes.

3. The combination claimed in claim 2 and wherein the vertical spacing between the articulated joints along said common axes, respectively, is substantially greater than the lateral spacing between said common axes.

4. The combination claimed in claim 3 and wherein said substantially greater distance is more than double the lateral spacing between said common axes.

5. The combination claimed in claim 1 and in which said post member is disposed substantially equidistantly from said first and second axes.

* * * * *